United States Patent [19]

Ruiz

[11] 4,393,546

[45] Jul. 19, 1983

[54] OYSTER SPLITTER

[76] Inventor: Jorge M. Ruiz, Rte. 1, Box 30, Fletcher La., Walker, La. 70785

[21] Appl. No.: 303,401

[22] Filed: Sep. 18, 1981

[51] Int. Cl.[3] ..... A22C 29/04

[52] U.S. Cl. ..... 17/76

[58] Field of Search ..... 17/76, 75, 74, 48

[56] References Cited

U.S. PATENT DOCUMENTS

| | | | |
|---|---|---|---|
| 210,032 | 11/1878 | Heimlich | 17/76 |
| 332,403 | 12/1885 | Leduc | 17/76 |
| 3,231,930 | 2/1966 | Berry | 17/76 |
| 4,127,919 | 12/1978 | Buddecke | 17/76 X |

*Primary Examiner*—Willie G. Abercrombie

*Attorney, Agent, or Firm*—Reginald F. Roberts, Jr.

[57] ABSTRACT

The present invention provides a safe, dependable, and simple device for splitting the shells of oysters and clams. The device comprises a support, and shell-splitting means pivotally connected to the support.

This invention also provides a method for splitting the shells of oysters and clams. The method comprises the steps of (a) providing a device which includes a support and shell-splitting means pivotally connected to the support; (b) depositing an oyster or clam on the support in the path of the shell-splitting means; and (c) moving the shell-splitting means pivotally toward the support, thereby contacting and splitting the shell of the oyster or clam.

1 Claim, 3 Drawing Figures

OYSTER SPLITTER

BACKGROUND OF THE INVENTION

The present invention relates to splitting shells. More particularly, this invention relates to a mechanical device for splitting oyster shells.

Oyster shells are presently split manually, with a special type of knife known as an oyster knife. The operation of splitting the oyster shell involves a degree of effort, skill, experience, and risk of being cut by the oyster knife. It is therefore very desirable to provide a device which will perform this function without the disadvantages inherent in the present method. Such a device will perform the same function for clams, the shells of which are structurally very similar to oyster shells.

SUMMARY OF THE INVENTION

In general, the present invention provides a device for splitting oyster and clam shells. The device comprises a support; and shell-splitting means, pivotally connected to the support. Shell-splitting means are herein defined as means adapted to split the shell of an oyster or clam by forceful impact, without sustaining significant structural damage or deformation. Shell-splitting means include, for example, a strong, sturdy blade or pointed cone fastened to a rigid bar.

This invention also provides a method for splitting the shells of oysters and clams. The method comprises the steps of (a) providing a device which includes a support and shell-splitting means pivotally connected to the support; (b) depositing an oyster or a clam on the support in the path of the shell-splitting means; and (c) moving the shell-splitting means pivotally toward the support, thereby contacting and splitting the shell of the oyster or clam.

It is an object of this invention to provide a device for splitting oyster and clam shells. It is a further object of the invention to provide a mechanical device which will split oyster shells without exposing the person operating the device to a substantial risk of injury. It is a still further object of the invention to provide a device therefor which requires a minimum of effort, skill, and experience for its operation. Other objects of the invention will be apparent to those skilled in the mechanical and culinary arts by the more detailed description which follows.

DESCRIPTION OF THE PREFERRED EMBODIMENTS

The following description illustrates the manner in which the principles of the present invention are applied, but is not to be construed as in any sense limiting the scope of the invention.

Figure 1:
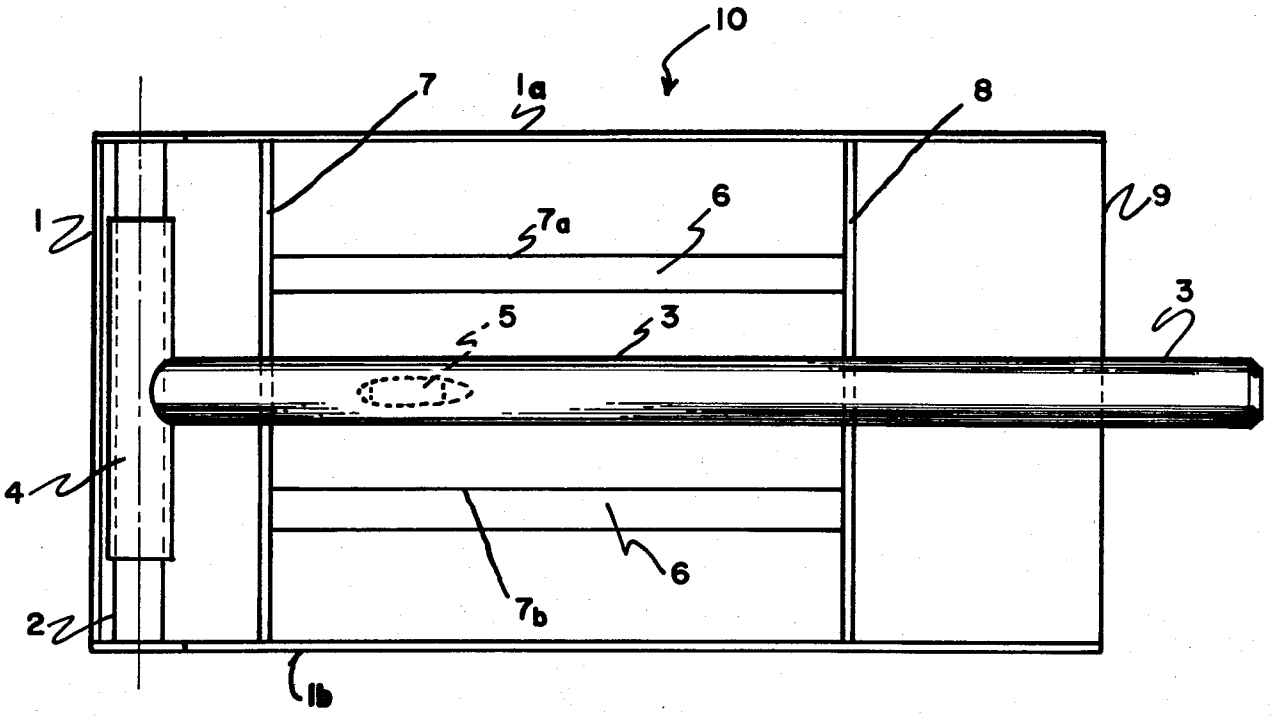
FIGS. 1, 2, and 3 are a plan view, a side elevation, and an end view, respectively, of a device for splitting clam and oyster shells according to the present invention.
Figure 2:
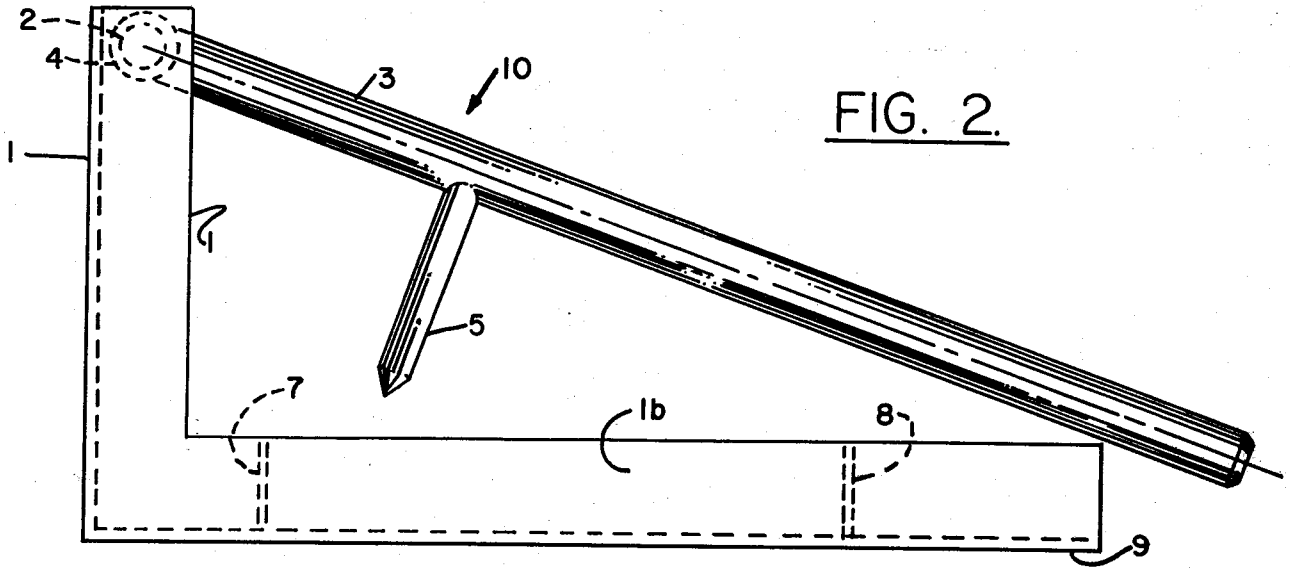
Figure 3:
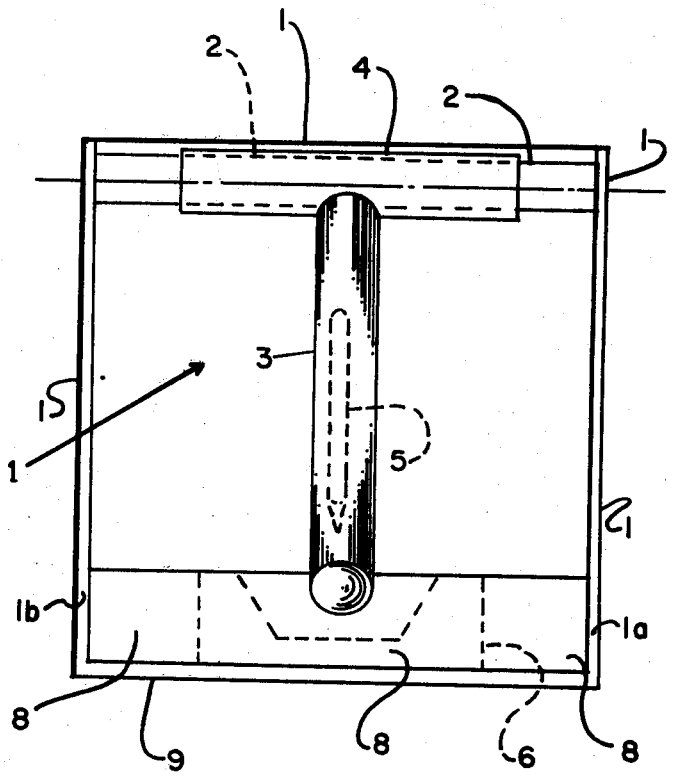

More specifically, reference is made to FIGS. 1, 2, and 3, wherein are shown a device 10 according to the present invention. A base 9 is connected to the lower end of a frame 1. A first bar 3 is pivotally connected at one end to the frame 1. Perpendicular to the first bar 3 is a second bar 5, connected at one end to the first bar 3.

The second bar 5 includes a hard, substantially conical edge at its other end.

The first bar 3 is connected to the frame 1 by means of a bearing 4 and a third bar 2. The third bar 2 is substantially perpendicular to the first bar 3. The first and third bars 3 and 2 are connected to one another by the bearing 4, which is coaxial with the third bar 2 and which permits the first bar 3 to rotate freely about the axis of the third bar 2.

The device 10 includes means for positioning an oyster or clam on the base 9 in the path of the second bar 5 as the first bar 3 is moved pivotally downward from an initial position in which the conical edge of the second bar 5 is not in contact with the shell of the oyster or clam to a final position in which the conical edge of the second bar 5 contacts and splits the shell of the oyster or clam.

The means for positioning the oyster or clam comprise an enclosure. The enclosure includes a hard, wedge-shaped trough 6. The enclosure further includes a first wall 7, which is substantially perpendicular to the base 9 on which the trough 6 rests. Second, third, and fourth walls 8, *7a*, and *7b*, respectively, are provided for the enclosure; and the trough 6 and walls 7, 8, *7a*, and *7b* are connected to one another and to the base 9.

The bars 3, 5, and 2 are rigid bars. More preferably, they are solid metal rods. The bearing 4 is preferably a sleeve bearing. The base 9 is preferably a flat metal plate which may include side walls 1*a* and 1*b*.

The first and second bars 3 and 5 may be fabricated from a single piece of metal. If desired, the sleeve bearing 4 may be fabricated from the same piece of metal, whereby the bars 3 and 5 and the sleeve bearing 4 are all of one piece.

The device 10 may be operated manually. The person operating the device 10 may simply swing the first bar 3 downward until the conical edge of the second bar 5 contacts and splits the shell of the oyster or clam. To provide sufficient force for this operation without undue effort on the part of the operator, the first and second bars 3 and 5 may be of sufficient weight to ensure sufficient striking force when the first bar 3 is allowed to swing freely under gravity from a position in which it is substantially horizontal, to its final position in which the second bar 5 contacts and splits the shell of the clam or oyster.

Alternatively, the first bar 3 may include an added weight, such as a solid metal block at the junction of the first and second bars 3 and 5, to supply the weight necessary to split the shell when the device 10 is operated with gravity as the driving force. A third mode of operation is to place the second bar 5 in contact with the oyster or clam shell, then strike the first bar 3 with a mechanical tool such as a hammer, thereby providing the force required to split the shell. In these and any other modes of manual operation, the first bar 3 may be provided at its other end with a handle, which is not shown in the drawings.

The device 10 is not limited to manual operation. Mechanical means may be provided, for example an electric motor, for pivotally moving the first bar 3. The electric motor may include a reducing gear for controlling the speed of the motor and a mechanism for reversing the direction of the motor. These mechanical means are not shown in the drawings.

The device 10 may be automated. Thus, the device 10 may include automatic means such as a microprocessor, for automatically moving the first bar 3 pivotally downward to split the oyster or clam shell, and thereafter automatically moving the first bar 3 pivotally upward after the shell of the oyster or clam has been split. Such automatic means may also include means for actuating the electric motor in a forward mode when an oyster or a clam is deposited on the base in the path of the second bar 5, whereby the first bar 3 is moved pivotally downward from an initial position in which the conical edge of the second bar 5 is not in contact with the shell of the oyster or clam to a final position in which the conical edge of the second bar 5 contacts and splits the shell of the oyster or clam. Such automatic means may further include means for automatically reversing the direction of the electric motor after the shell has been split, whereby the first bar 3 is moved pivotally upward to its initial position. The device 10 may further include automatic means for deactuating the electric motor after the first bar 3 has been moved pivotally upward to its initial position. These automatic means are not shown in the drawings.

The device 10 may be further automated for use on a commercial scale; for example, in an oyster-canning factory. For this degree of automation, means are provided for automatically positioning the oyster or clam on the base 9 in the path of the second bar 5 as the first bar 3 is moved pivotally downward to split the shell of the oyster or clam. Additional means are provided for automatically removing the oyster or clam from the base 9 after the shell of the oyster or clam has been split, and after the first bar 3 has been or is being moved pivotally upward to its initial position. An example of such means is a belt-conveyor including a plurality of enclosures, which moves continuously across the surface of the base 9 in a direction perpendicular to the first bar 3. These means are further automation of the device 10 are not shown in the drawings.

While certain representative embodiments and details have been shown for the purpose of illustrating the present invention, it will be apparent to those skilled in the art that various changes and modifications can be made therein without departing from the spirit and scope of the invention. For example, the shell-splitting means could be pivotally connected to the base 9, thereby eliminating the need for the frame 1. As a second example, the shell-splitting means could comprise a single bar, one end of which is connected to the support and the other end including a knife-edge. As a third example, the entire device could be vertically mounted, on a wall for example. While such variations do not represent the preferred embodiment, they fall within the scope of the present invention.

I claim:

1. A device for splitting oyster and clam shells, comprising:

(a) a support, which includes a base and a frame, the base further including an enclosure for positioning the oyster or clam; and (b) shell-splitting means including a first bar pivotally connected to the frame, and a second bar substantially perpendicular to the first bar, one end of the second bar fastened to the first bar, the second bar including at its other end a hard, substantially conical edge; the first bar fastened to and substantially perpendicular to a third bar which is coaxial with a bearing fastened to the frame, whereby the first bar is capable of free rotation about the axis of the third bar.

* * * * *